US008920736B2

(12) United States Patent
Liu

(10) Patent No.: US 8,920,736 B2
(45) Date of Patent: Dec. 30, 2014

(54) LOOP SEAL FOR RECYCLING SOLIDS FROM A CYCLONE AND FLUIDIZED BED REACTOR AND METHOD USING THE SAME

(75) Inventor: Guohai Liu, Birmingham, AL (US)

(73) Assignee: Synthesis Energy Systems, Inc., Houston, TX (US)

( * ) Notice: Subject to any disclaimer, the term of this patent is extended or adjusted under 35 U.S.C. 154(b) by 7 days.

(21) Appl. No.: 13/376,291

(22) PCT Filed: Jun. 5, 2010

(86) PCT No.: PCT/US2010/037558

§ 371 (c)(1), (2), (4) Date: Feb. 21, 2012

(87) PCT Pub. No.: WO2010/141930

PCT Pub. Date: Dec. 9, 2010

(65) Prior Publication Data

US 2012/0138861 A1 Jun. 7, 2012

Related U.S. Application Data

(60) Provisional application No. 61/184,320, filed on Jun. 5, 2009.

(51) Int. Cl.

| | |
|---|---|
| ***B01J 8/18*** | (2006.01) |
| ***F23C 10/32*** | (2006.01) |
| ***F23C 10/10*** | (2006.01) |
| *B01J 8/00* | (2006.01) |
| *B01J 19/00* | (2006.01) |
| *B01J 19/24* | (2006.01) |

(52) U.S. Cl.

CPC ..... *F23C 10/10* (2013.01); *F23C 10/32* (2013.01)

USPC ..... 422/139; 422/129; 422/187; 422/211; 422/212; 422/213; 422/214; 422/232; 422/233

(58) Field of Classification Search

CPC ..... B01J 8/00; B01J 8/18; B01J 8/1809; B01J 8/1827; B01J 8/1845; B01J 8/1863; B01J 8/1872; B01J 19/00; B01J 19/24; B01J 2208/00; B01J 2208/00743; B01J 2208/00752; B01J 2208/00761; B01J 2208/00769

USPC ..... 422/129, 139, 187, 211–214, 232, 233

See application file for complete search history.

(56) References Cited

U.S. PATENT DOCUMENTS 4,217,132 A 8/1980 Burge et al.
4,276,062 A * 6/1981 Lyon et al. ..... 95/108

(Continued)

FOREIGN PATENT DOCUMENTS

EP 549252 A1 * 6/1993

*Primary Examiner* — Natasha Young

(74) *Attorney, Agent, or Firm* — Cesari and McKenna, LLP

(57) ABSTRACT

A loop seal for a fluidized bed reactor comprising a vertical downcomer segment connected to a dipleg for receiving solids particles from the dipleg, a horizontal segment downstream of the downcomer, a riser segment downstream of the horizontal segment, and a downwardly inclined segment downstream of the riser, whereby the solids are entrained to the fluidized bed reactor. An eductor is added to the angled leg to induce the underflow gas from the cyclone; one of the preferred motive fluids to the eductor is the fines from fuel preparation and the carrying gas for the fines. Also provided are a fluidized bed reactor comprising the loop seal, and a method for producing syngas from coal and steam using the same.

11 Claims, 4 Drawing Sheets

(56) References Cited

U.S. PATENT DOCUMENTS

| | | | | |
|---|---|---|---|---|
| 4,931,260 | A * | 6/1990 | Molerus et al. | 422/147 |
| 5,293,843 | A | 3/1994 | Provol et al. | |
| 5,510,085 | A | 4/1996 | Abdulally | |
| 5,682,828 | A | 11/1997 | Phalen et al. | |
| 5,735,682 | A | 4/1998 | Toth | |
| 6,237,541 | B1 | 5/2001 | Alliston et al. | |
| 6,488,901 | B1 * | 12/2002 | Schmidt et al. | 423/148 |
| 8,277,736 | B2 * | 10/2012 | Proll et al. | 422/141 |
| 2008/0081844 | A1 | 4/2008 | Shires et al. | |
| 2008/0216655 | A1 | 9/2008 | Vimalchand et al. | |
| 2009/0093555 | A1 | 4/2009 | Stites et al. | |
| 2010/0282075 | A1 * | 11/2010 | Force et al. | 95/12 |

* cited by examiner

LOOP SEAL FOR RECYCLING SOLIDS FROM A CYCLONE AND FLUIDIZED BED REACTOR AND METHOD USING THE SAME

CROSS REFERENCE TO RELATED APPLICATIONS

This application is a national phase application of PCT/US2010/037558 filed Jun. 5, 2010 which also claims the benefit of U.S. Provisional Application No. 61/184,320 filed Jun. 5, 2009. The contents of the prior application are incorporated herein by reference.

FIELD OF THE INVENTION

The present invention is related to a method and apparatus for solids collection and recycling in a fluidized bed reactor. Specifically, the present invention relates to solids collection by a cyclone and returning the solids to a fluidized bed while preventing gas reverse flow from the fluidized bed region via loop seal with aeration gas and an eductor. Aeration gas used for the loop seal will also be the gasification agent. Also the present invention is related to an operating method to create gas underflow from the cyclone by an eductor, wherein one of the motive fluids to the eductor can be the fuel fines with the carrying gas. The invention is further related to the caking coal treatment in the fluidized bed gasifier.

BACKGROUND OF THE INVENTION

Gasification of solid carbon fuels, especially coal, with steam and air or oxygen to produce a synthetic gas ("Syngas") containing high concentrations of hydrogen and carbon monoxide has been practiced for many years. This classic fuel industry process is known as the water gas reaction, and can be depicted by the idealized equation:

$$C+H_2O \rightarrow CO+H_2.$$

The reaction is also called steam gasification reaction, which is highly endothermic, i.e., the reaction absorbs heat from the surroundings. Commercial gasification of solid fuel began during the latter half of the 19th century with the development of the fixed-bed process, wherein a bed of carbonaceous solid, usually coke, is heated red hot by partial combustion, followed by introduction of steam until the endothermic reaction has cooled the bed below the reaction temperature; the bed is then blasted with air to raise its temperature, followed by steam.

During the 1920's, fluidized-bed technology was applied to gasification on a commercial scale to gasify fine fuel particles. A fluidized bed gasifier comprises of a cylindrical vessel in which a certain height of carbonaceous solids particles forms a bed; some gas, mainly steam and oxygen, is provided to the bed through a distributor, also called grid. The lifting force of the gas makes the whole bed materials act like fluids and the gas flowing through the bed forms many bubbles of different sizes. The fluidized bed gasifier is thus also called bubbling bed gasifier. To have the entire bed materials lifted by the gas fed to the gasifier, it is necessary to prepare the fuel particles to the desired sizes. For most bubbling fluidized beds, the particle size used is in the range of 0-10 mm, preferably about 0-6 mm. To obtain the desired size of fuel particles, the raw fuel has to go through the crush and grinding processes. In the fuel preparation process, fine particles, or fines, less than 45 microns in size, can reach as high as 10% of the fuel added to the gasifier. Some of the fines can be entrained by the bubble and have low carbon conversion.

The carried fines often cannot be collected by the conventional cyclones. Therefore, it is an urgent issue in the fluidized bed operation to capture the fines, return them to the reaction region, to achieve high carbon conversions for the fines from fuel preparation process.

The fluidized bed gasifier is generally operated at a temperature of about 1,000° C. and various pressures to promote the gasification reaction cited above. To supply heat to the endothermic reaction, some of the carbon in the bed will react with oxygen through combustion reaction. Because the coal particles are fed to the gasifier near the ambient temperatures and suddenly heated to the operating temperature, a lot of fragmentations occur to generate additional fines. These additional fines in the size of 0-50 microns are also hard to collect and recycle. Furthermore, particles collected on the cyclone wall can also be entrained by the gas flow in the cyclone.

Another issue related to the fluidized bed coal gasification is the difficulty with a special type of coal called bituminous coal, which generates plastic materials when suddenly heated up in a fluidized bed to 450° F. to 1,000° F. in the gasifier. This is commonly referred to as caking, which can generate lumps in the bed. The large lumps can cause clinker formation in the fluidized bed when they sink to the bottom of the bed and react with oxygen. The most vicious materials in the caking process are the fines in the coal feed because the fines by nature are generally more quickly heated up than larger particles and therefore have a higher tendency of forming lumps. Reducing caking is desired because it stabilizes fluidized bed operation and resulting in less shutdown due to caking related clinker formation, and broadens the range of coal that can be fed into the gasifier.

Furthermore, the interaction between the bubbles and the particles and that between the gas jetting out of the grid or the distributor can cause particle attrition, which will generate additional fines. The size of the fines is in the range of 0-50 microns. The amount of fines generated depends on the fuel or char particle properties or the initial fines presented in the fuel fed, the design of the gas distributors and the amount of solids particles in the bed.

The fines are the most fundamental issue facing the fluidized bed gasification operation, and effective collection of the fines and recycling them to the gasifier are essential for the fluidized bed gasifier to survive. The fines issue is so severe in the fluidized bed gasifier that one of the fluidization experts (A. M. Squires, 1982, Contributions toward a History of Fluidization, *Proceedings of Joint Meeting of Chemical Industry & Engineering Society of China and American Institute of Chemical Engineers*, Beijing, September 19-22, pp 322-353) predicted that no fluidized bed gasifier would be built due to the carbon loss with the fine particles. The fines contain between 10-60% of carbon and therefore must be utilized in the gasifier for the technology to be economically competitive. One approach to utilize the fines involves collecting the fines through a collection device such as a cyclone and returning the fines through a dipleg and pressure sealing system to the gasifier. In an ideal situation, the fines collected will be returned to the oxidization region of the fluidized bed, because the reaction rate or the carbon consumption rate in the oxidation region is many times faster than in a reduced or oxygen deficiency atmosphere. Therefore, in the oxidization atmosphere, the carbon particles can be consumed before leaving the bed by the gas lifting forcer. The reaction between the fines and oxygen can provide the heat to the bed for endothermic reactions and syngas generation.

The difficulty in fine particle collection lies in the small size of particle (0-20 microns) and low particle density. Some of these particles will be entrained to the gas and escape the collection. Even if they are collected by the cyclone, it is difficult to return them to the fluidized bed. The most conventional method used in the fluidized bed is an angled dipleg 80 as shown in FIG. 1. In principle, the solids can flow into the fluidized bed from the cyclone 90 by the accumulation of the solids in the dipleg 80 establishing a static head of the solids particles. The salient feature of angled dipleg 80 configuration is that no or very little aeration is required for the solids to return to the fluidized bed 100. However, the fundamental problem with the configuration is that the gas can flow upwards through the dipleg 80, which is detrimental to the cyclone function because it can blow the collected particles into the exit of the cyclone 90 as illustrated in FIG. 2. The inclined dipleg is thus disfavored for this reason (see. e.g. Knowlton, T. M., in Handbook of Fluidization and Fluid-particle Systems, edited by Yang, W.; Marcel Dekker, Inc., 2003). Knowlton teaches a method of using a bypass line and a valve on the line to prevent the large gas bubble rushing up-flow to spoil the cyclone and causes loss efficiency. However, it is impractical both economically and technically to install a valve in the solids return line for the application of gasification because of the high temperature and high pressure operation with solids flows in the line. The fundamental issue is still unresolved in the coal gasification field for the gas reverse flow and carbon losses from the fluidized bed gasifier are still very severe.

One way to avoid carbon losses from the fluidized bed is to adopt an apparatus called loop seal widely used in the circulating fluidized bed boiler, which completely burns the coal to generate steam for power generation or for steam production. An example of such a boiler is given in U.S. Pat. No. 6,237,541 to Allison et. al. To make the solids flowing from the dipleg though the loop seal returning to the bed of the combustor, it is necessary to provide some gas to the loop seal, termed aeration. In the circulating fluidized bed boiler, the gas used for the loop seal aeration can be air or recycled flue gas. U.S. Pat. No. 5,339,774 teaches the techniques to use the recycled flue gas as aeration gas to the loop seal. However, these techniques cannot be easily applied to the fluidized bed gasifier. Because the high carbon content of the gasifier solids and small particle size and low density, any oxygen in the dipleg will cause the carbon to combust in the dipleg to melt the particles and form clinkers in the dipleg. The consequence is the gasifier has to shut down. The aeration gas has to be oxygen free. Also due to the extremely small particles, the added aeration can even cause the cycle to lose efficiency. That is why loop seal has not widely been used in the fluidized bed gasifier. The essential issue here is to ensure that nearly all aeration added has to flow downwards to the gasifier not to the cyclone.

The additional difficulty with the solids collection and recycle system is the pressure fluctuation in the fluidized bed gasifier. These fluctuations can cause the pressure momentously in the bed much higher than the static head of solids in the dipleg, resulting in gas reverse flow from the dipleg to the cyclone. When reverse flow happens, the cyclone loses efficiency. Because such pressure fluctuation can occur frequently, the cyclone efficiency will suffer even with the loop seal. That is one of the main reasons that the fluidized bed gasifier tends to have low cyclone efficiency.

To avoid loss of efficiency in cyclone, the gas reverse flow has to be completely avoided. Furthermore, the cyclone collection efficiency can be improved by forcing a fraction of the gas to flow with the collected solids; in the art of the cyclone collection, it is termed as the gas underflow. Gas underflow will improve the cyclone collection efficiency; and the higher the gas under flow rate, the higher the cyclone collection efficiency. U.S. Pat. No. 5,690,709 to Barnes teaches the art to induce up to 2.5% of the cyclone inlet gas as underflow. However, all those practices are aimed to improving the efficiency of the third stage separator for fluid catalytic cracker (FCC). Where the gas underflow can be relatively easily to induced because the collected solids flow to a vessel or pipe where the pressure roughly equals to or is lower than that at the cyclone inlet. And for nearly all of the applications of underflow cyclones, the gas and solids are introduced to different chambers that are physically isolated using some sorts of walls. For the fluidized bed gasifier, the solids need to return to the fluidized bed where the pressure is about 3-5 pounds per square inch or 20-35 kPa higher than that at the cyclone gas inlet. Because the operating temperature of the gasifier can be as high as 2000° F., it is impractical or economically prohibitive to physically separate the gas solids flow into different chambers as have been done in the third stage separators in FCC. Thus it remains a serious challenge to introduce gas underflow from a cyclone to improve its efficiency in this setting.

In short, although fluidized bed gasifier has been in commercial operation since the 1920's, it remains an unsolved problem for fluidized bed gasifiers that excessive carbon loss occurs from the gasifier as fly ash, and it remains difficult to feed the fines to the gasifier and to handle caking of coal fines.

The present invention provides an apparatus, as well as a method, that improves the fluidized bed operation that solves the above problems.

SUMMARY OF THE INVENTION

The present invention provides an innovative solution to the problems related to collection of particles entrained in a gas stream from a fluidized bed gasifier, recycling of the collected particles to the gasifier, enhancing the cyclone collection efficiency by inducing up to 20% of the cyclone inlet gas as underflow gas by an eductor and feeding fuel fines to the eductor motive gas nozzles to break the caking of coal fines. The method used in the invention is the combination of a loop seal and an eductor, using recycle gas aeration and feeding fines to the loop seal to break caking In one embodiment, the present invention provides a loop seal for a fluidized bed reactor, wherein the fluidized bed reactor comprises a fluidized bed region encased in a reaction vessel, at least one cyclone in fluid communication with the fluidized bed region for receiving a first gas-solid mixture which comprises product gas and solids particles from the bed reactor region, and wherein the cyclone is connected to a dipleg through which the solids particles separated from the gas-solid mixture in the cyclone are collected, the loop seal comprising a vertical downcomer segment connected to the dipleg for receiving solids particles from the dipleg, a horizontal segment downstream of the downcomer, a riser segment downstream of the horizontal segment, and a downwardly inclined segment downstream of the riser which is connected back to the fluidized bed region, wherein solids collected in the cyclone is re-entrained through the riser to the fluidized bed region and gas from the fluidized bed region is prevented from reverse flowing to the dipleg. The cyclone is preferably a first stage cyclone connected directly to the fluidized bed reactor and the solids particles are collected and returned to the fluidized bed region for further reaction.

In another embodiment of the present invention, an eductor with motive gas nozzle is part of the loop seal assembly to induce the additional gas flow from the cyclone. The underflow gas from the bottom of the cyclone can improve the collection efficiency of the cyclone. The amount of underflow gas is between 0-20% of the gas entrance into the cyclone.

In one embodiment, the present invention design the location and angel and inlet velocity of the inlet nozzle of the loop seal pipe entrance to the fluidized bed such that the particles from the loop seal can be directly to the center of the fluidized bed, where the oxygen concentration is high and where a flame zone is located.

In another embodiment, the present invention provides a means to feed coal fines to motive gas nozzle. The gas generated by the coal fines devolatilization and gasification can provide a high nozzle tip velocity to induce the gas underflow from the cyclone.

In one embodiment, the prevent invention provides a means to utilize the caking coals in the fluidized bed by feeding the fines from the coal to the oxidization zone to break the caking from the fines produced plastic materials during the fines heating up and by mixing the fuel fines with the fines collected by the cyclone to prevent the fine particles from contacting each other.

DETAILED DESCRIPTION OF THE INVENTION

In one embodiment, the preset invention provides a gasifier system comprising a cyclone, a vertical dipleg, a loop seal and a connection port to the gasifier, at least one feeder that feeds fuel to the gasifier, a compressor that will recycle either $CO_2$ or syngas to inject the gas to the loop seal as aeration, an eductor in the riser of the loop seal.

Figure 1:
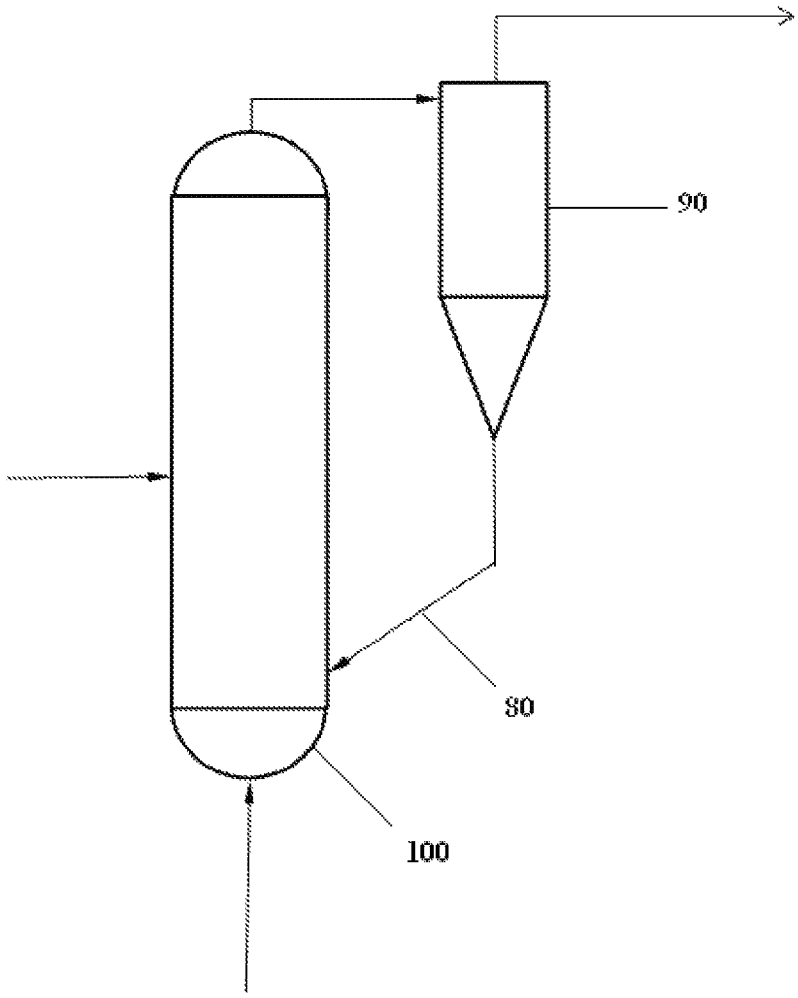
(Prior Art) Figure 1
FIG. 1 is a schematic drawing showing an assembly of the gasifier and the loop seal with the first stage cyclone.
Figure 2:
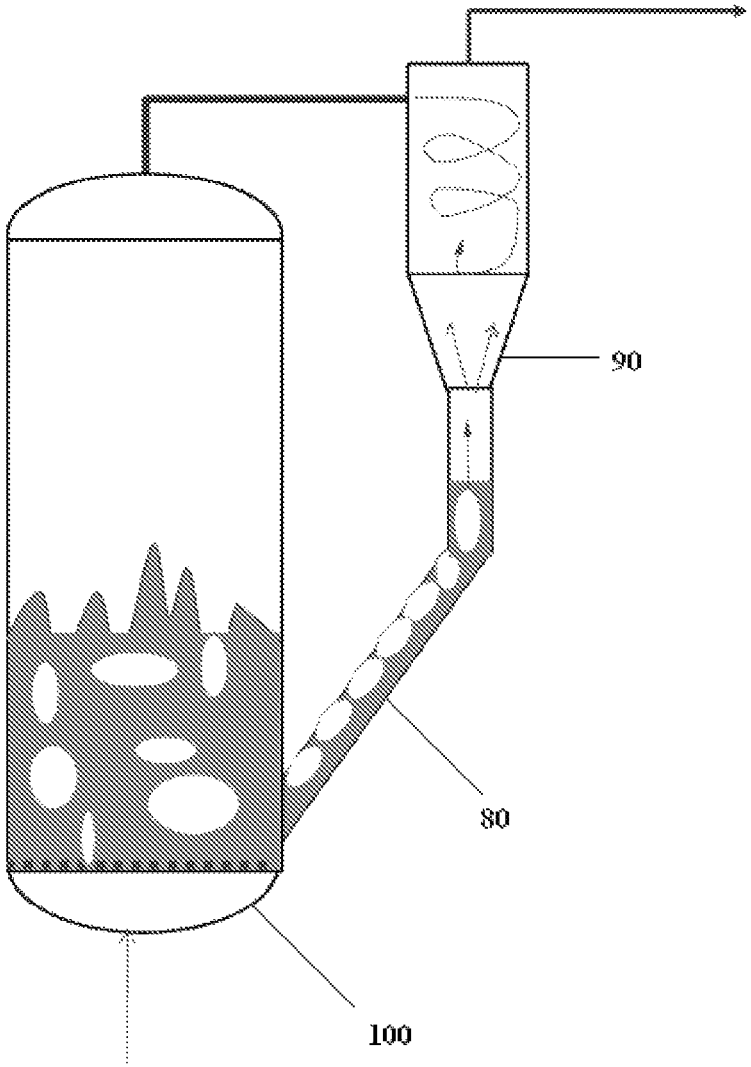
(Prior Art) Figure 2
FIG. 2 is an illustration of prior art with an angled dipleg.
Figure 3:
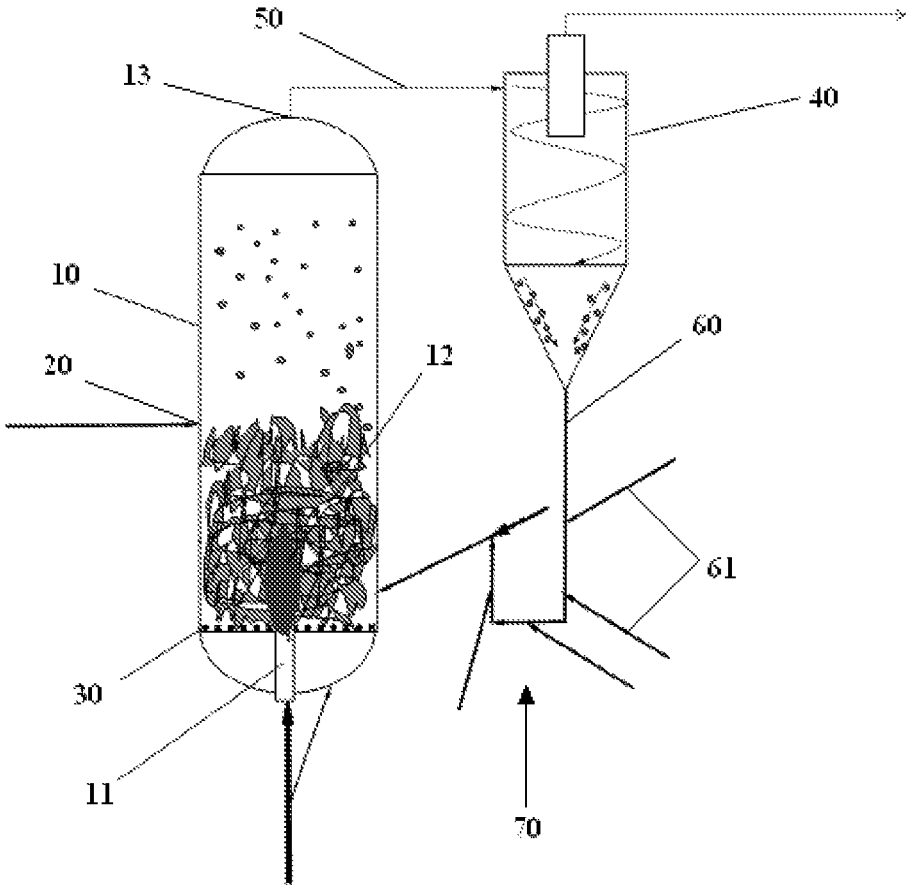
FIG. 3 is a schematic drawing showing an assembly of the gasifier and the loop seal with the gas underflow due to the action of the eductor in the pipe connecting the loop seal and the gasifier.

One embodiment of the present invention is now illustrated with reference to FIG. 3. In a preferred embodiment, the present invention is used for a fluidized bed gasifier. The most conventional fluidized bed gasifier comprises a vertical vessel 10, feed nozzles 20, a gas distributor 30, at least one cyclone 40, a pipe 50 connecting the cyclone 40 and the gasifier vessel 10, a cyclone dipleg 60 connecting to the gasifier 10 (see FIGS. 1 and 2). Some of the fluidized bed gasifier has a center pipe 11 through which the majority of the steam and oxygen or the carbonaceous solid feed is injected. The fuel used for gasification is also fed into the bed through injection nozzles 20 in communication with the bed and the feeders. For the gasifier with a center pipe 11, the steam and oxygen will react with the carbon in the bed to produce syngas and create a flame zone 12 at the tip of the center pipe 11 (FIG. 3). The temperature in the flame zone 12 is much higher than that in the bed.

The steam and oxygen injected into the gasifier though the center pipe 11 and the grid 30 will form bubbles in the bed of solids. The bubbles will travel upwards in the bed; the large bubbles generally travel faster than the smaller ones and therefore coalesce with small bubbles in the path of these flowing large bubbles. At the surface of the bed, these bubbles burst; the gas from the bubbles will flow as a continuous phase above the bed and many small particles ejected from the bed will be carried upward to the exit 13 of the gasifier vessel 10. Solids carried by the gas from the gasifier tangentially enter the first stage cyclone 40 and are collected in the wall region of the cyclone 40. The collected solids flow along the cyclone wall into a vertical dipleg 60 connected to the lower end of the cyclone 40. The bottom of the dipleg 60 is connected to a loop seal 70, where the solids are forced to make two turns to reach the gasifier 10. In a conventional gasifier, the collected solids may be re-entrained due to the gas up flow from the cyclone dipleg.

In the present invention, the solids collected through cyclone 40 will flow downwards to the loop seal 70. Normally, the static pressure in the loop seal 70 can prevent the gas from upwards flow.

Figure 4:
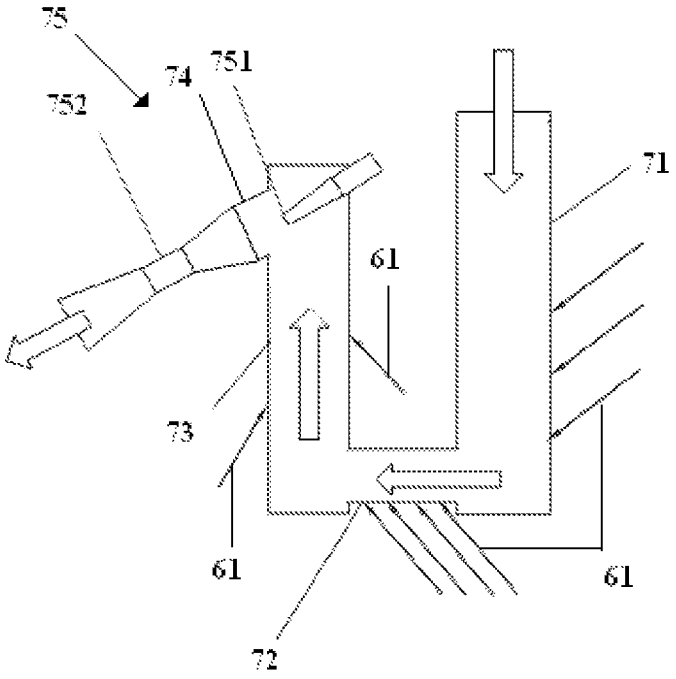
FIG. 4 is a schematic drawing showing an assembly of the loop seal with an eductor located in the angled line connecting the gasifier and the loop seal.

FIG. 4 shows in more detail of an assembly of the loop seal 70, which comprises a downcomer 71 connected to the dipleg 60, or forms a part of the dipleg 60. The downcomer 71 receives the solids from the cyclone 40. The lower end of the downcomer 71 is connected through a horizontal leg 72, to a riser 73, in which solids and gas mixture will flow upwards. An inclined leg 74 is connected to the upper end of the riser 73 and the gasifier 10. Through the inclined leg 74 the solids are returned to the gasifier 10.

A plurality of nozzles 61 may be provided throughout the dipleg 60 and loop seal 70, between the cyclone 40 and the gasifier 10 to facilitate the flow of the collected solids. The gas injected into the nozzles 61 is called aeration gas. The aeration gas used for the dipleg 60 is either steam or $CO_2$. In a proper designed loop seal 70, the amount of aeration will be just sufficient for fluidizing the particles in the dipleg 60. The majority of the aeration gas will be entrained by the solids flowing through the loop seal 70 and end up in the fluidized bed gasifier 10. However, a conventional loop seal has no guarantee that all added gas will flow into the bed of the gasifier all the time.

The loop seal design 70 of the present invention is advantageous in that it prevents the gas from reverse flowing from the gasifier 10 to the dipleg 60 and also prevents the aeration gas from flowing upwards to the gasifier 10 while allowing the solids collected by the cyclone 40 to flow into the gasifier 10 through the gas underflow in the cyclone 40, increasing solids-to-gas conversion efficiency.

In one preferred implementation of the present invention, an eductor 75 is used in the connection of the angled pipe 74 connecting the riser 73 of the loop seal 70 and the gasifier. The function of the eductor 75 is to induce the gas underflow from the cyclone 40 to increase the cyclone collection efficiency.

The amount of gas induced depends on the motive gas flow rates and motive gas pressure. In a preferred embodiment of the current invention, the velocity ratio between the motive gas at the nozzle tip 751 and the mixture in the throat 752 of the eductor 75 (see FIG. 4 for details) shall be in the range of 10-100. At the high velocity ratio, the entire loop seal 70 can be in a relative dilute flow. The underflow gas can reach 1-20% of the total gas enters the cyclone inlet. For the intended gasification application of the invention, an increase in the gas underflow is an advantageous feature for the gasifier operation. It not only improves the cyclone collection efficiency to retain more carbon in the system but also enhance the carbon conversion of the collected fines. The majority of the entrained gas burns when encounters with oxygen. The reaction of the gas with oxygen will increase the temperature of the fine particle and the fines can react with oxygen or steam or $CO_2$ faster in a high temperature atmosphere.

Due to the force from the eductor 75 and high velocity of the gas solids mixture through the throat 752 of the eductor 75, the pressure fluctuations in the fluidized bed will no longer propagate towards the dipleg 60. The flow stability of the dipleg 60 will be improved and therefore the cyclone collection efficiency and the solids flow stability in the dipleg 60 and the loop seal 70 will be improved too.

The location and angle of the inclined pipe 74 connecting the gasifier 10 and the loop seal riser 73 will in a preferred layout facilitate the fines collected from the cyclone to reach the flame zone 12 of the gasifier 10. In the flame zone 12, the carbon in the fines can easily be converted to ash and syngas. Since the cyclone 40 has a better efficiency in collecting the ash particles than that in collecting the carbon particles, the conversion of the char or carbon particles will further improve the collection efficiency of the cyclone 40.

The fluid as motive gas through the eductor nozzle 751 can also be the fuel and its carrying gas. In this manner, at least a portion of fuel is fed into the gasifier 10 through the motive gas nozzle 751. The gas carrying fuel particles and product gas of the fuel will be utilized in inducing underflow gas from the cyclone 40 as a motive fluid. In such an implementation, the pressure of the gas for feeding the fuel at this location will be much higher than that used for other fuel injection nozzles.

In a preferred implementation of the present invention, the fuel fed to the eductor motive nozzle 751 is the fines generated in the fuel preparation process. In the most conventional practice of gasification, the fines generated from the fuel preparation process are collected by a baghouse, where the filter bags will act as the barrier for the fines. The collected fines will be mixed with other fuels in the feeded silos. Since the mixing process can be non-uniform, sometimes a batch of fines will reach the feeder, which is designed for feeding relatively coarser particles. The fines can cause difficulties in the feeding process. As a part of this invention, the fines will be fed separately to the motive gas nozzle 751 through a separate feeder which will be designed for feeding the fines.

The fines with the carrying gas when injected into the high temperature region of the tip of the eductor 75 will generate gases as both gasification and devolatilization products. The volume of the gas will be 100-1000 times of the volume of the fines fed to the nozzle 751. The rapid expansion in the volume from the issuing nozzle 751 of the eductor 75 can generate a high velocity and therefore a higher suction force and therefore induce a higher fraction of gas underflow. The feeding fuel to the eductor nozzle 751 can improve the eductor effect without a high velocity inside the nozzle 751.

Fines fed through the eductor nozzles 751 will be added to the oxidation zone, preferably the flame region 12. The exiting oxygen and other fines from the cyclone 40 can essentially prevent the caking particles from sticking together. The mass ratio of the recycled fine particles to fuel fines fed will be in the range of 20-100. The probability of the fuel particles to contact with each other will be greatly reduced. Without contacting together many fuel particles, the chance of forming lump has disappeared. Therefore, the invention can solve the caking coal gasification issues.

What is claimed is:

1. A fluidized bed reactor comprising:

a fluidized bed region encased in a reaction vessel, a feed nozzle for feeding fuel particles into the bed region, a center pipe for injecting steam and oxygen into the bed region, and a gas distributor for promoting the reaction between gases and fuel particles to produce syngas, a cyclone in fluid communication with the bed region for receiving a gas-fuel particle mixture which comprises product syngas and fuel particles from the bed region, wherein the cyclone is connected to a dipleg through which the fuel particles separated from the gas-fuel particle mixture in the cyclone are collected, a loop seal downstream of the cyclone, the loop seal comprising:

i) a vertical downcomer segment, connected to the dipleg for receiving fuel particles from the dipleg;

ii) a horizontal segment, downstream of the downcomer;

iii) a riser segment, downstream of the horizontal segment;

iv) a downwardly inclined segment, downstream of the riser segment, which is connected to the bed region, and v) an eductor in the downwardly inclined segment, the eductor comprising a nozzle located within the eductor and connected to a source of fine particles, wherein the fine particles are delivered to the bed reactor through the nozzle within the eductor and the downwardly inclined segment of the loop seal, wherein the fuel particles collected in the cyclone are re-entrained through the riser to the bed region and the gases from the bed region is prevented from reverse flowing to the dipleg.

2. The fluidized bed reactor according to claim 1, wherein the cyclone is a first stage cyclone.

3. The fluidized bed reactor according to claim 2, wherein the eductor uses steam or $CO_2$ as motivation gas.

4. The fluidized bed reactor according to claim 3, wherein the diameter of a throat region of the eductor is smaller than the rest of the eductor.

5. A method for producing syngas from coal and steam using a fluidized bed reactor of claim 1.

6. The method according to claim 5, wherein the mass ratio of the recycled solid particles to the fuel fines fed to the eductor nozzle is in the range of 20to 100.

7. The method according to claim 6, wherein the velocity ratio of the motive gas at the nozzle tip to the mixture in the eductor throat is in the range of 10 to 100.

8. The method according to claim 7, wherein the eductor of the loop seal induces 0-20% of the gas underflow to the eductor nozzle.

9. The fluidized bed reactor according to claim 1, wherein the bed region comprises a flame zone, and the downwardly inclined segment of the loop seal is positioned to deliver fine particles to the flame zone.

10. The fluidized bed reactor according to claim 1, wherein the source of fine particles comprises fines particles generated in a fuel preparation process.

11. The fluidized bed reactor according to claim 1, wherein the feed nozzle is connected to a fuel source from which fine particles have been removed by a fuel preparation process.

* * * * *